US006774557B2

(12) United States Patent
Jansma

(10) Patent No.: US 6,774,557 B2
(45) Date of Patent: Aug. 10, 2004

(54) FLUORESCENT LAMP HAVING REDUCED MERCURY CONSUMPTION

(75) Inventor: Jon B. Jansma, Pepper Pike, OH (US)

(73) Assignee: General Electric Company, Schenectady, NY (US)

( * ) Notice: Subject to any disclaimer, the term of this patent is extended or adjusted under 35 U.S.C. 154(b) by 160 days.

(21) Appl. No.: 09/900,348

(22) Filed: Jul. 5, 2001

(65) Prior Publication Data

US 2003/0006695 A1 Jan. 9, 2003

(51) Int. Cl.[7] ..... H01J 1/62; H01J 63/04
(52) U.S. Cl. ..... 313/489; 313/486
(58) Field of Search ..... 313/486, 489, 313/635; 427/167

(56) References Cited

U.S. PATENT DOCUMENTS 4,079,288 A * 3/1978 Maloney et al. ..... 313/489
4,544,997 A * 10/1985 Seuter et al. ..... 362/263
5,268,614 A * 12/1993 Labib et al. ..... 313/486
5,417,886 A * 5/1995 Tateiwa et al. ..... 252/301.4 R
5,614,783 A 3/1997 Fujino
5,619,096 A 4/1997 Kaliszewski et al.
5,666,027 A * 9/1997 Jaspers ..... 313/635
5,753,999 A * 5/1998 Roozekrans et al. ..... 313/489
5,801,482 A 9/1998 Verhaar et al.
5,869,927 A * 2/1999 Matsuo et al. ..... 313/485
5,907,216 A 5/1999 Ligthart et al.
6,174,213 B1 1/2001 Paz de Aruajo et al.
6,222,318 B1 4/2001 Oomen et al.

* cited by examiner

*Primary Examiner*—Alan Cariaso
*Assistant Examiner*—Sumati Krishnan
(74) *Attorney, Agent, or Firm*—Pearne & Gordon LLP

(57) ABSTRACT

A mercury vapor discharge lamp is provided having either a yttria-dispersed alumina barrier layer, or a yttria-dispersed phosphor layer with no barrier layer. The yttria-dispersed layer is preferably coated directly on the inner surface of the glass envelope of a fluorescent lamp, and substantially reduces mercury depletion via reaction with the glass envelope. Preferably, the yttria-dispersed layer also has a fine coating of yttria deposited over the surfaces of the coating particles, and over the inner surface of the glass envelope. A method of preparing a coating layer having such a yttria coating, and yttria particles uniformly dispersed therethrough, is also provided.

20 Claims, 1 Drawing Sheet

FLUORESCENT LAMP HAVING REDUCED MERCURY CONSUMPTION

BACKGROUND OF THE INVENTION

1. Field of the Invention

The present invention relates generally to a fluorescent lamp, and more particularly to a fluorescent lamp having reduced mercury consumption.

2. Description of Related Art

Mercury vapor discharge fluorescent lamps are well known in the marketplace. Their operation depends upon the excitation of mercury vapor atoms via an electric discharge, and the resonance energy given off when the excited atoms return to their ground state. Each lamp therefore contains a quantity of mercury sufficient to maintain the desired mercury vapor pressure within the sealed lamp (typically 4–6 $\mu$m Hg). So long as the mercury vapor within the lamp remains at the desired pressure, the lamp will continue to operate normally, producing maximum lumens.

Unfortunately, mercury vapor is depleted over the lamp's life via a number of known mechanisms. These mechanisms include reaction with phosphor particles or phosphor additives in the phosphor coating, and reaction with the glass envelope itself. Reaction with the glass envelope is the most significant source of mercury vapor depletion, however both reactions deplete mercury vapor by consuming atomic mercury in a chemical reaction.

One solution to this problem has been to provide an alumina or silica barrier layer on the inner surface of the glass envelope to prevent mercury attack. Alumina and silica have been somewhat successful at abating mercury-glass reactions, however it is known that yttria is more effective than either alumina or silica for this purpose. Yttria barrier layers are not used because the greater cost of yttrium makes yttria barrier layers economically unfeasible.

A second solution (often implemented in addition to an alumina or silica barrier layer) has been to dose fluorescent lamps with excess liquid mercury. The result is that as mercury vapor is consumed, more liquid mercury vaporizes to sustain a dynamic equilibrium at mercury's vapor pressure. However, increasing environmental concerns, as well as state and federal regulation of mercury, are requiring lamp manufacturers to dose fluorescent lamps with less mercury, not more, and excess liquid mercury is fast becoming a non-option.

There is a need in the art for a means of preventing, or substantially reducing, mercury consumption in fluorescent lamps. Such means preferably would eliminate the need for dosing a fluorescent lamp with substantial excess liquid mercury. Further, such means preferably would provide the benefits of yttria without necessitating a yttria barrier layer.

SUMMARY OF THE INVENTION

A mercury vapor discharge lamp is provided which has a light-transmissive glass envelope with an inner surface, means for providing a discharge, a barrier layer coated adjacent the inner surface of the glass envelope, a phosphor layer coated adjacent the inner surface of the barrier layer, and a fill gas of mercury and an inert gas sealed inside the envelope. The barrier comprises barrier layer substrate particles and 0.1–10 wt. % yttria. The barrier layer also has crystalline yttria particles uniformly dispersed throughout.

A mercury vapor discharge lamp is also provided which has a light-transmissive glass envelope with an inner surface, means for providing a discharge, a phosphor layer coated adjacent the inner surface of the glass envelope, and a fill gas of mercury and an inert gas sealed inside the envelope. The phosphor layer comprises phosphor particles and 0.001–10 wt. % yttria. The phosphor layer also has crystalline yttria particles uniformly dispersed throughout.

A method of providing a coating layer in a fluorescent lamp is also provided. The method comprises the steps of a) providing a suspension of 1–10 wt. % coating layer substrate particles in a suspension medium of deionized water; b) dissolving a yttrium salt in the suspension; c) adding hydrochloric acid to the suspension to bring the suspension to a pH of 3–6; d) applying the suspension to the inner surface of a glass envelope of a fluorescent lamp; e) drying the suspension coated on the inner surface of the glass envelope to provide a partially dried coating layer wherein the dissolved yttrium salt is at least partially recrystallized thereby; and f) baking the coating layer to dry the coating layer and to oxidize the recrystallized yttrium salt to yttria. The yttria is dispersed throughout the coating layer.

DETAILED DESCRIPTION OF THE PREFERRED EMBODIMENTS OF THE INVENTION

In the description that follows, when a preferred range, such as 5 to 25 (or 5–25), is given, this means preferably at least 5, and separately and independently, preferably not more than 25.

As used herein, a "fluorescent lamp" is any mercury vapor discharge fluorescent lamp as known in the art, including fluorescent lamps having electrodes, and electrodeless fluorescent lamps where the means for providing a discharge include a radio transmitter adapted to excite mercury vapor atoms via transmission of an electromagnetic signal.

Also as used herein, a "T8 lamp" is a fluorescent lamp as known in the art, preferably linear, preferably nominally 48 inches in length, and having a nominal outer diameter of 1 inch (eight times ⅛ inch, which is where the "8" in "T8" comes from). Less preferably, the T8 fluorescent lamp can be nominally 2, 3, 6 or 8 feet long, less preferably some other length.

Figure 1:
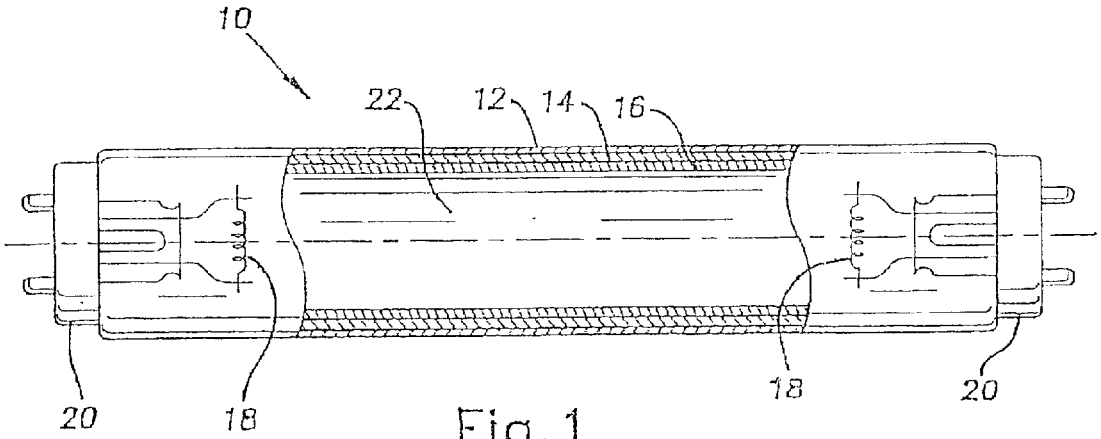
FIG. 1 shows a first preferred embodiment of a mercury vapor discharge fluorescent lamp according to the present invention.

FIG. 1 shows a mercury vapor discharge fluorescent lamp 10 according to a first preferred embodiment of the present invention. Though the lamp in FIG. 1 is linear, the invention is not limited to linear lamps and may be applied to fluorescent lamps of any shape. The fluorescent lamp 10 has a light-transmissive glass tube or envelope 12 which has a circular cross-section.

The lamp is hermetically sealed by bases 20 attached at both ends and, in lamps having electrodes (such as that in FIG. 1), a pair of spaced electrode structures 18 are respectively mounted on the bases 20. A discharge-sustaining fill gas 22 of mercury and an inert gas is sealed inside the glass tube. The inert gas is preferably argon or a mixture of argon and krypton, less preferably some other inert gas or gas mixture. The inert gas and a small quantity of mercury vapor provide the low vapor pressure manner of operation.

Preferably, the mercury vapor has a pressure of 4–6 μm Hg, approximately mercury's vapor pressure at 25° C.

In the first preferred embodiment, the fluorescent lamp 10 has a barrier layer 14, and a phosphor layer 16. Barrier layer 14 comprises substrate particles that make up the principal component of the barrier layer. In this embodiment, the barrier layer 14 is coated adjacent, preferably directly on, the inner surface of the glass envelope 12, and the phosphor layer 16 is coated adjacent, preferably directly on, the inner surface of the barrier layer 14. The barrier layer 14 is preferably an alumina barrier, wherein the barrier layer substrate particles are alumina particles. Preferably, barrier layer 14 comprises a mixture of substantially equal proportions of alpha- and gamma-alumina particles as the substrate particles. Less preferably or alternatively, the barrier layer can be a silica, hafnia, zirconia, vanadia, or niobia barrier layer, less preferably some combination or mixture thereof.

A preferred alumina barrier layer has a coating weight of 0.05–3, preferably about 0.12–0.15, mg/cm$^2$. The alumina particles preferably have a mean particle size of 15–800, preferably 20–600, preferably 20–400, preferably 22–300, preferably 25–200, preferably 30–100, nm. Barrier layer 14 also comprises a quantity of crystalline yttria uniformly dispersed among the alumina particles. Most preferably, the alumina particles in barrier layer 14 and the inner surface of glass envelope 12 also have a film of crystalline yttria substantially uniformly disposed or coated over their respective surfaces. Preferably, barrier layer 14 comprises 0.1–10, preferably 0.4–8, preferably 0.6–6, preferably 1–4, preferably 1.53, preferably about 2, wt. % yttria, balance alumina.

Phosphor layer 16 preferably is a rare earth phosphor layer, such as a rare earth triphosphor layer known in the art. Less preferably, phosphor layer 16 can be a halophosphate phosphor layer as known in the art. Phosphor layer 16 preferably has a coating weight of 1–5 mg/cm$^2$.

A lamp according to the first preferred embodiment exhibits substantially reduced mercury consumption via reaction with glass envelope 12 due to the presence of yttria in the barrier layer 14. The uniformly deposited yttria film has been shown to be very effective at abating mercury consumption by the glass envelope without the need of a fully yttria-constituted barrier layer. Further, the presence of yttrium ions in the alumina coating suspension promotes resistance to wash-off during subsequent phosphor coating steps.

Figure 2:
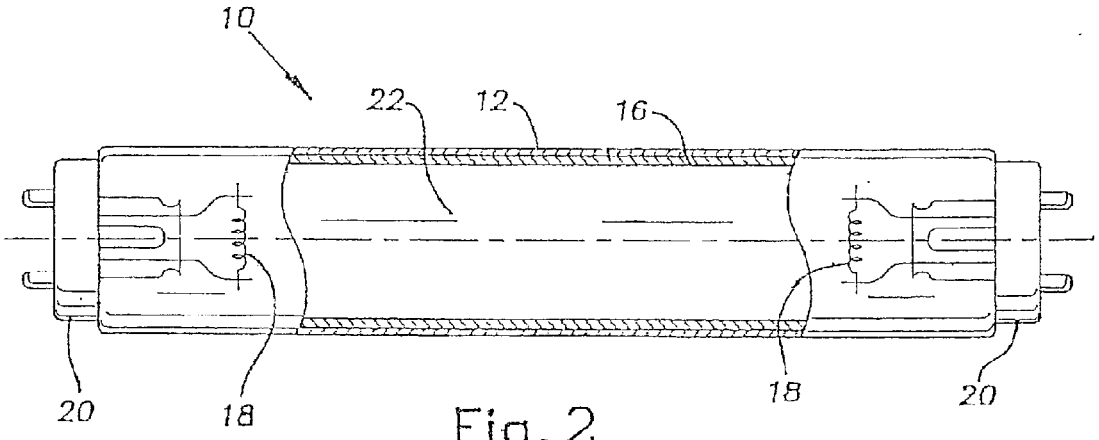
FIG. 2 shows a shows a second preferred embodiment of a mercury vapor discharge fluorescent lamp according to the present invention.

FIG. 2 shows a lamp according to a second preferred embodiment of the invention, where the fluorescent lamp 10 has a phosphor layer 16, but no barrier layer 14. In this embodiment, the phosphor layer 16 is coated adjacent, preferably directly on, the inner surface of the glass envelope 12. Phosphor layer 16 is preferably a rare earth phosphor layer, such as a rare earth triphosphor layer known in the art. Less preferably, phosphor layer 16 can be a halophosphate phosphor layer as known in the art. Phosphor layer 16 preferably has a coating weight of 1–5 mg/cm$^2$.

The phosphor layer 16 also comprises a quantity of crystalline yttria uniformly dispersed among the phosphor particles. Most preferably, the phosphor particles in phosphor layer 16 and the inner surface of glass envelope 12 have a film of crystalline yttria substantially uniformly disposed or coated over their respective surfaces. Preferably, phosphor layer 16 has 0.001–10, preferably 0.01–5, wt. % yttria. The balance of the phosphor layer comprises halophosphors, or rare earth phosphors, where individual phosphors (e.g., red-, blue-, and green-emitting rare earth phosphors) are combined as known in the art in the proper proportions to achieve a fluorescent lamp having desired color temperature and CRI characteristics. The proportions of individual phosphors necessary to provide a desired lamp are essentially unaffected by the presence of yttria particles. Furthermore, a phosphor layer according to the present embodiment, that is prepared according to the method described below, results in a yttria film over the surface of individual phosphor particles that is sufficiently thin to avoid, or to substantially avoid, adverse optical effects.

A lamp according to this embodiment exhibits substantially reduced mercury consumption via reaction with glass envelope 12 due to the presence of yttrium in the phosphor layer 16. In addition, mercury consumption by reaction with phosphor particles or phosphor additives is also substantially reduced. A phosphor layer comprising 0.001–10 wt. % yttria and constituted as here described results in no, or negligible, reduction in lumen output. Thus, the invented phosphor layer effectively prevents or substantially reduces mercury depletion in the fluorescent lamp, thus providing the benefits of yttria without the high cost or lumen loss associated with a principally constituted yttria layer, optionally, phosphor layer 16 contains 0.5–4, preferably 0.6–3, preferably 0.7–2, preferably 0.8–1.5, preferably about 1, wt. % colloidal alumina particles to promote cohesion of the phosphor layer and adhesion to the glass envelope. A phosphor layer according to this embodiment is very effective at abating mercury consumption (via reaction with the glass envelope or phosphor particles) without a separate barrier layer. Thus the additional materials, time and cost associated with a barrier layer coating step are eliminated.

A lamp according to either the first or second preferred embodiment above need be dosed with significantly less liquid mercury to maintain the desired 4–6 μm Hg vapor pressure during the lamp's life. For a typical existing T8 lamp, mercury dosing can range from 7 mg all the way to 40 mg initial mercury content. Currently, the lowest mercury-dose T8 lamps have from 7 to 9 mg of mercury. A comparable invented lamp having similar performance and longevity is dosed with less than mg, preferably less than 4.5, 4, or 3.5, mg, preferably between 3–3.5 mg, of mercury. That represents about a 50% decrease in mercury without sacrificing lumens or longevity.

A preferred method for providing an alumina barrier coating layer according to the first preferred embodiment will now be described. Differences in the method for preparing a phosphor coating layer according to the second preferred embodiment will be indicated parenthetically.

The barrier layer is initially prepared as an aqueous suspension or slurry, and the slurry is then coated on the inside surface of the glass envelope 12 by known coating means. The suspension is prepared as follows. Deionized water is provided as the suspension medium. The alumina (or phosphor) particles are added to the suspension medium to make up about 1–10, preferably 1–5, wt. % of the total suspension. Next, the remaining non-dissolving components are added in conventional amounts to the suspension medium and stirred or homogenized to form a stable aqueous suspension. The non-dissolving components include thickeners, dispersants and other additives to regulate the suspension's physical properties. Preferred thickeners are nonionic, water soluble polymeric thickeners such as POLYOX (polyethylene oxide). Suitable dispersants are nonionic and include Pluronic F108 and Igepal CO-530. Pluronic F108 is a block copolymer surfactant mixture of polyoxyethylene and polyoxypropylene available from BASF. Igepal CO-530 is nonylphenol ethoxylate and is available from Rhodia.

Next, a yttrium salt is added to the suspension such that the proportion of yttrium salt to the alumina (or phosphor) particles is equal to that stated above for the barrier (or phosphor) layer. Other suspension components, such as water and dispersants, are not factored into the yttrium salt weight percent calculation. Preferred yttrium salts are yttrium chloride and yttrium nitrate, though any water soluble organic or inorganic yttrium salt can be used; (e.g. suitable organic yttrium salts include yttrium acetate and yttrium carbonate). Once the yttrium salt has been dissolved in the aqueous suspension and stirred to uniform composition, aqueous hydrochloric acid is added to bring the suspension to a pH of 3–6 to avoid the formation of insoluble yttrium hydroxide. Preferably, the HCl solution is about 3.5 wt. % HCl or about 1.2M $HCl_{(aq)}$.

The suspension is then applied to the inner surface of glass envelope 12 by known coating means. Once applied, the coating is partially dried via forced air convection, and then baked at an elevated temperature, e.g. at least 400° C., 500° C. or 600° C. for about 0.5–10 minutes. As the water is vaporized from the suspension, the concentration of the dissolved yttrium salt approaches saturation. Yttrium salts are highly soluble in water. Hence, the yttrium salt concentration rises uniformly throughout the coating layer as the water evaporates such that once saturation is achieved and the salt begins to crystallize, a highly uniform dispersion of yttrium salt crystals is formed, as well as a thin yttrium salt film over all of the available surfaces. The film forms over the surfaces of the glass envelope 12 and of the individual alumina (or phosphor) particles. Under baking conditions, the yttrium salt is oxidized to yttrium oxide (or yttria), thus providing the yttria dispersion and yttria film of the present invention. It should be noted that yttrium salt crystallization, and oxidation to yttria, may (and very likely do) occur simultaneously, or at least overlap. It is not intended that crystallization and oxidation must occur in two discrete steps.

It is important that the yttria purity is sufficiently high, preferably at least 95, preferably 96, preferably 97, preferably 98, preferably 99, wt. %, to minimize light absorption or formation of light absorbing color centers. Unfortunately, most commercially available yttrium salts are not very pure. A preferred method for obtaining a high purity yttrium salt is to dissolve commercially available high purity yttrium oxide (yttria) in $HCl_{(aq)}$ or $HNO_{3(aq)}$ followed by neutralization to pH 7.0. HCl will yield soluble yttrium chloride and $HNO_3$, yttrium nitrate. This neutral yttrium salt solution is then added to the suspension to achieve the appropriate yttria weight percent as explained above.

The invention will be further understood in conjunction with the following example.

EXAMPLE 1

Three fluorescent lamps were constructed. The first lamp (Lamp 1) had an alumina barrier layer coated on the interior surface of the glass envelope, and a rare earth triphosphor layer coated on the interior surface of the barrier layer. Neither layer contained yttria. The second lamp (Lamp 2) had only a rare earth triphosphor layer coated on the interior surface of the glass envelope; i.e. no barrier layer. The triphosphor layer contained no yttria. The third lamp (Lamp 3) also had only a rare earth triphosphor layer, but with 1 wt. % yttria added to the triphosphor layer. All three lamps were started and allowed to burn for 100 hours. Mercury consumption was measured in all three lamps with the following results:

Lamp 1: 3% loss by weight of mercury after 100 hrs.

Lamp 2: 18% loss by weight of mercury after 100 hrs.

Lamp 3: 5% loss by weight of mercury after 100 hrs.

As can be seen, Lamp 3 containing the yttria dispersed phosphor layer, and no barrier layer, prevented mercury consumption nearly as well as Lamp 1 which included a barrier layer. It will be understood that by eliminating the need for a barrier layer to abate mercury consumption, a coating step is eliminated from the lamp making process.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mercury vapor discharge fluorescent lamp comprising a light-transmissive glass envelope having an inner surface, means for providing a discharge, a barrier layer coated adjacent said inner surface of said glass envelope, a phosphor layer coated adjacent the inner surface of said barrier layer, and a fill gas of mercury and an inert gas sealed inside said envelope, said barrier layer comprising barrier layer substrate particles and 0.1–10 wt. % yttria, said barrier layer having crystalline yttria particles dispersed throughout said barrier layer.

2. A lamp according to claim 1, wherein said barrier layer is an alumina barrier layer.

3. A lamp according to claim 2, said alumina barrier layer comprising a mixture of alpha- and gamma-alumina particles having a mean particle size of 15–800 nm.

4. A lamp according to claim 2, said alumina barrier layer having a coating weight of 0.05–3 $mg/cm^2$.

5. The lamp of claim 2, said barrier layer comprising 1.5–3 wt. % yttria.

6. The lamp of claim 2, said barrier layer comprising about 2 wt. % yttria.

7. A lamp according to claim 1, said barrier layer further comprising a yttria film coated over the surfaces of said barrier layer substrate particles and said inner surface of said glass envelope.

8. The lamp of aim 7, wherein each of said barrier layer substrate particles has a yttria film substantially uniformly cost over its surface.

9. A lamp according to claim 1, said barrier layer being selected from the group consisting of silica, hafnia, zirconla, vanadia, and niobia barrier layers, and mixtures thereof.

10. A lamp according to claim 1, said lamp being a TB lamp initially containing less than 5 mg of mercury.

11. The lamp of claim 1, said barrier layer comprising 1–4 wt. % yttria.

12. A mercury vapor discharge lamp comprising a light-transmissive glass envelope having an inner surface, means for providing a discharge, a phosphor layer coated adjacent the inner surface of said glass envelope, and a fill gas of mercury and an inert gas sealed inside sad envelop, said phosphor layer comprising phosphor particles and 0.001–10 wt. % yttria, said phosphor layer having crystalline yttria particles dispersed throughout said phosphor layer, said phosphor layer further comprising a yttria film coated over the surfaces of said phosphor particles and said inner surface of said glass envelope, each of said phosphor particles having a yttria film substantially uniformly coated over its surface, said yttria film being formed from yttrium dissolved in a liquid medium.

13. A lamp according to claim 12, wherein said phosphor layer is a rare earth triphosphor layer.

14. A lamp according to claim 12, wherein said phosphor layer has a costing weight of 1–5 mg/cm$^2$.

15. A lamp according to claim 12, wherein said phosphor layer is a halophosphate layer.

16. A lamp according to claim 12, said limp being a T8 lamp initially containing less than 5 mg of mercury.

17. The lamp of claim 12, said phosphor layer comprising 0.01–5 wt. % yttria.

18. The lamp of claim 12, said phosphor layer comprising 1 wt. % yttria.

19. The lamp of claim 12, wherein said lamp is free from the presence of a barrier layer between said phosphor layer and said glass envelope.

20. The lamp of claim 12, wherein the yttria film coated over the surfaces of said phosphor particles is sufficiently thin to substantially avoid adverse optical effects.

* * * * *

UNITED STATES PATENT AND TRADEMARK OFFICE

CERTIFICATE OF CORRECTION

PATENT NO. : 6,774,557 B2
DATED : August 10, 2004
INVENTOR(S) : Jon B. Jansma

It is certified that error appears in the above-identified patent and that said Letters Patent is hereby corrected as shown below:

Column 6,
Line 49, please delete "aim" and insert therefore -- claim --.
Line 55, please delete "TB" and insert therefore -- T8 --.

Column 7,
Line 4, after "yttrium" please add -- salt --.
Line 12, please delete "limp" and insert therefore -- lamp --.

Signed and Sealed this

Thirtieth Day of November, 2004

JON W. DUDAS
*Director of the United States Patent and Trademark Office*